US010409183B1

(12) United States Patent
Kobayashi

(10) Patent No.: US 10,409,183 B1
(45) Date of Patent: Sep. 10, 2019

(54) POSITIVELY CHARGEABLE TONER

(71) Applicant: KYOCERA Document Solutions Inc., Osaka (JP)

(72) Inventor: Ryota Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/216,692

(22) Filed: Dec. 11, 2018

(30) Foreign Application Priority Data

Feb. 16, 2018 (JP) ..... 2018-025719

(51) Int. Cl.
*G03G 9/08* (2006.01)
*G03G 9/087* (2006.01)

(52) U.S. Cl.
CPC ..... *G03G 9/0825* (2013.01); *G03G 9/0812* (2013.01); *G03G 9/0821* (2013.01); *G03G 9/0819* (2013.01); *G03G 9/08755* (2013.01)

(58) Field of Classification Search
CPC ..... G03G 9/09725
See application file for complete search history.

(56) References Cited

U.S. PATENT DOCUMENTS

2018/0267416 A1* 9/2018 Uchino ..... G03G 9/0825

FOREIGN PATENT DOCUMENTS

JP 2010-198004 A 9/2010

* cited by examiner

*Primary Examiner* — Peter L Vajda
(74) *Attorney, Agent, or Firm* — Studebaker & Brackett PC

(57) ABSTRACT

A positively chargeable toner includes toner particles. The toner particles each include a toner mother particle and an external additive attached to a surface of the toner mother particle. The external additive includes external additive particles each including a silica base and a coat layer covering the silica base. The coat layer contains lanthanum atoms. The coat layer has a surface having hydrophobicity.

6 Claims, 1 Drawing Sheet

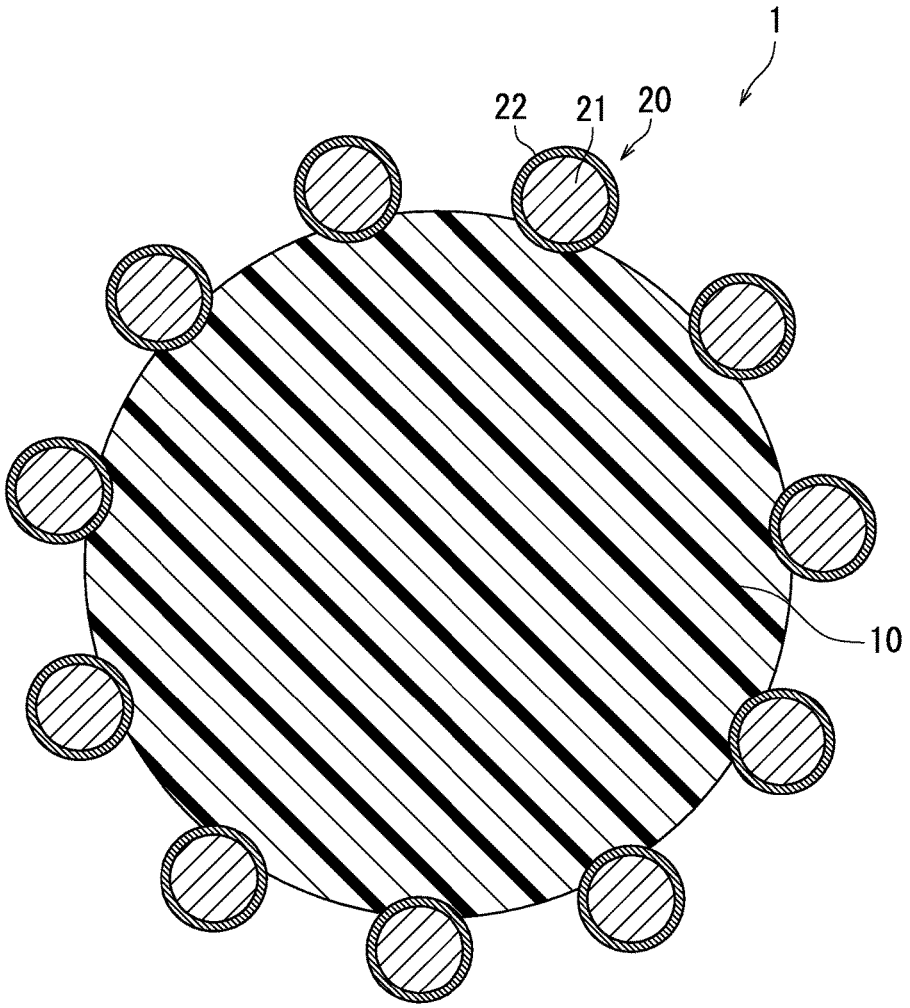
1
22
21
20
10

POSITIVELY CHARGEABLE TONER

INCORPORATION BY REFERENCE

The present application claims priority under 35 U.S.C. § 119 to Japanese Patent Application No. 2018-025719, filed on Feb. 16, 2018. The contents of this application are incorporated herein by reference in their entirety.

BACKGROUND

The present disclosure relates to a positively chargeable toner.

A known positively chargeable toner includes toner particles each including a toner mother particle and an external additive attached to a surface of the toner mother particle. Silica particles surface-treated with aminosilane or the like are for example used as an external additive in a known positively chargeable toner.

SUMMARY

A positively chargeable toner according to the present disclosure includes toner particles. The toner particles each include a toner mother particle and an external additive attached to a surface of the toner mother particle. The external additive includes external additive particles each including a silica base and a coat layer covering the silica base. The coat layer contains lanthanum atoms. The coat layer has a surface having hydrophobicity.

BRIEF DESCRIPTION OF THE DRAWINGS

FIGURE is a diagram illustrating an example of a sectional structure of a toner particle included in a positively chargeable toner according to an embodiment of the present disclosure.

DETAILED DESCRIPTION

The following describes a preferable embodiment of the present disclosure. Note that a toner is a collection (for example, a powder) of toner particles. An external additive is a collection (for example, a powder) of external additive particles. Values indicating evaluation results (i.e., values indicating shape, physical properties, or the like) for a powder (specific examples include a powder of external additive particles) are each a number average of values measured for an appropriate number of particles selected from the powder, unless otherwise stated.

A measured value for a volume median diameter ($D_{50}$) of a powder is a median diameter measured using a laser diffraction scattering particle size distribution analyzer ("LA-950" manufactured by HORIBA, Ltd.), unless otherwise stated. A number average primary particle diameter of a powder is a number average value of equivalent circle diameters of 100 primary particles (Heywood diameters: diameters of circles having the same areas as projected areas of the primary particles) of the powder measured using a scanning electron microscope, unless otherwise stated.

The term "chargeability" refers to chargeability in triboelectric charging, unless otherwise stated. Strength of positive chargeability (or strength of negative chargeability) in triboelectric charging can be confirmed from a known triboelectric series or the like. A toner (measurement target) is for example triboelectrically charged by mixing and stirring the toner with a standard carrier (N-01 for a negatively chargeable toner, P-01 for a positively chargeable toner) provided by The Imaging Society of Japan. An amount of charge of the measurement target is measured before and after triboelectric charging using for example a compact draw-off charge measurement system ("MODEL 212HS" manufactured by TREK, INC.). A measurement target having a greater difference in amount of charge between before and after triboelectric charging has stronger chargeability.

The term "main component" of a material refers to a component that accounts for a largest proportion of the material in terms of mass, unless otherwise stated.

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "lanthanum oxide" refers to lanthanum(III) oxide represented by a compositional formula $La_2O_3$. The term "hydrophobing treatment" refers to treatment that increases strength of hydrophobicity. Strength of hydrophobicity can be indicated by a contact angle with respect to a water droplet (water wettability), for example. A larger contact angle of a water droplet indicates stronger hydrophobicity. The term "positive-chargeability imparting treatment" refers to treatment that increases strength of positive chargeability.

<Positively Chargeable Toner>

A positively chargeable toner (hereinafter may be simply referred to as a toner) according to the present embodiment can for example be favorably used for development of electrostatic latent images. The toner according to the present embodiment is a collection (for example, a powder) of toner particles (particles each having a configuration described below). The toner may be used as a one-component developer. Alternatively, the toner may be mixed with a carrier using a mixer (for example, a ball mill) to prepare a two-component developer. The toner according to the present embodiment is positively charged through friction with a carrier, a development sleeve, or a blade within a development device.

The toner particles included in the toner according to the present embodiment each include a toner mother particle and an external additive attached to a surface of the toner mother particle. The external additive includes external additive particles each including a silica base and a coat layer covering the silica base. The coat layer contains lanthanum atoms. The coat layer has a surface subjected to hydrophobing treatment.

Owing to the above configuration, positive chargeability of the toner according to the present embodiment can be favorably maintained in a high temperature and high humidity environment while occurrence of fogging in continuous printing can be inhibited through use of the toner according to the present embodiment. Reasons therefore are inferred as follows.

The toner particles included in the toner according to the present embodiment each include the external additive particles. The external additive particles each include the silica base and the coat layer covering the silica base. The coat layers of the external additive particles contain lanthanum atoms. The coat layers containing the lanthanum atoms are positively chargeable and have relatively high hardness. It is thought that as a result of the above, positive chargeability of the toner particles can be favorably maintained while wearing of the coat layers can be inhibited in continuous printing. Therefore, occurrence of fogging in continuous printing can be inhibited through use of the toner according to the present embodiment. Furthermore, the external additive particles each include the silica base and the coat layer covering the silica base and having the surface subjected to hydrophobing treatment. It is thought that as a result of the above, an amount of charge of the toner can be maintained in a high temperature and high humidity environment. Therefore, positive chargeability of the toner according to the present embodiment can be favorably maintained in the high temperature and high humidity environment.

The toner particles included in the toner according to the present embodiment may be toner particles including no shell layer or toner particles each including a shell layer (hereinafter may be referred to as capsule toner particles). Toner mother particles of the capsule toner particles each include a toner core for example containing a binder resin and a shell layer covering a surface of the toner core. The shell layer contains a resin. Both heat-resistant preservability and low-temperature fixability of the toner can be achieved for example by covering toner cores that melt at a low temperature with shell layers excellent in heat resistance. An additive may be dispersed in the resin forming the shell layer. The shell layer may cover the entire surface of the toner core or part of the surface of the toner core.

In order that the toner can be suitable for use in image formation, the toner mother particles preferably have a volume median diameter ($D_{50}$) of at least 4 μm and no greater than 9 μm in the present embodiment.

The toner mother particles for example contain the binder resin as a main component. The toner mother particles containing the binder resin may contain an internal additive (for example, at least one of a colorant, a releasing agent, a charge control agent, and a magnetic powder), as necessary.

The following describes details of the toner according to the present embodiment with reference to FIGURE as necessary.

[Structure of Toner Particles]

The following describes a structure of the toner particles included in the toner according to the present embodiment with reference to FIGURE. FIGURE illustrates an example of a sectional structure of a toner particle included in the toner according to the present embodiment. Note that FIGURE schematically illustrates elements of configuration to facilitate understanding. Size, the number, shape, and the like of each of the elements of configuration illustrated in FIGURE may differ from actual ones thereof to facilitate preparation of FIGURE.

As illustrated in FIGURE, a toner particle 1 includes a toner mother particle 10 and an external additive attached to a surface of the toner mother particle 10. The external additive includes external additive particles 20 each including a silica base 21 and a coat layer 22 covering the silica base 21. The coat layer 22 contains lanthanum atoms. In order that positive chargeability can be more favorably maintained in a high temperature and high humidity environment while occurrence of fogging can be more effectively inhibited in continuous printing, the amount of lanthanum atoms in terms of $La_2O_3$ is preferably at least 10% by mass and no greater than 30% by mass relative to a mass of the external additive particles 20, and more preferably at least 15% by mass and no greater than 20% by mass. The amount of the lanthanum atoms is measured by a method described later in Examples or an alternative method thereof.

The coat layer 22 covering the silica base 21 has a surface subjected to hydrophobing treatment. The coat layer 22 may cover the entire surface of the silica base 21 or part of the surface of the silica base 21. However, in order that positive chargeability can be more favorably maintained in a high temperature and high humidity environment while occurrence of fogging can be more effectively inhibited in continuous printing, the coat layer 22 preferably covers the entire surface of the silica base 21.

In order that positive chargeability can be more favorably maintained in a high temperature and high humidity environment while occurrence of fogging can be more effectively inhibited in continuous printing, the coat layer 22 preferably has a thickness of at least 0.1 nm and no greater than 0.5 nm. The thickness of the coat layer 22 can be measured through analysis of a transmission electron microscope (TEM) image of a cross section of the external additive particle 20 using commercially available image analysis software (for example, "WinROOF" manufactured by Mitani Corporation). Note that in a situation in which the coat layer 22 of the external additive particle 20 does not have a uniform thickness, thicknesses of the coat layer 22 are measured at four locations equally spaced from one another (specifically, four locations at which the coat layer 22 intersects with two straight lines crossing each other at right angles substantially at the center of a cross section of the external additive particle 20) and an arithmetic mean of the thus obtained four measurement values is determined as an evaluation value of the external additive particle 20 (thickness of the coat layer 22). In a situation in which a boundary between the silica base 21 and the coat layer 22 is obscure in the TEM image, the boundary can be clarified through mapping of a characteristic element (for example, La) contained in the coat layer 22 in the TEM image by a combination of transmission electron microscopy (TEM) and electron energy loss spectroscopy (EELS).

In order to more effectively inhibit occurrence of fogging in continuous printing, the external additive particles 20 preferably have a number average primary particle diameter of at least 15 nm. Also, in order to more favorably maintain positive chargeability through inhibition of detachment of the external additive particles 20 from the toner mother particles 10, the external additive particles 20 preferably have a number average primary particle diameter of no greater than 30 nm.

[Components of Toner Particles]

The following describes components of the toner particles included in the toner according to the present embodiment.

(Binder Resin)

In order to improve low-temperature fixability of the toner, the toner mother particles preferably contain a thermoplastic resin as a binder resin, and more preferably contain the thermoplastic resin in a proportion of at least 85% by mass relative to a whole mass of the binder resin. Examples of thermoplastic resins include styrene-based resins, acrylic acid ester-based resins, olefin-based resins (specific examples include polyethylene resins and polypropylene resins), vinyl resins (specific examples include vinyl chloride resins, polyvinyl alcohols, vinyl ether resins, and N-vinyl resins), polyester resins, polyamide resins, and urethane resins. Copolymers of the above-listed resins, that is, copolymers formed through introduction of a repeating unit into the above-listed resins (specific examples include styrene-acrylic acid ester-based resins and styrene-butadiene-based resins) can also be used as binder resins.

A thermoplastic resin can be obtained through addition polymerization, copolymerization, or condensation polymerization of at least one species of thermoplastic monomer. Note that a thermoplastic monomer is a monomer that forms a thermoplastic resin through homopolymerization (specific examples include acrylic acid ester-based monomers and styrene-based monomers) or a monomer that forms a thermoplastic resin through condensation polymerization (specific examples include a combination of a polyhydric alcohol and a polycarboxylic acid that form a polyester resin through condensation polymerization).

In order to improve low-temperature fixability of the toner, the toner mother particles preferably contain a polyester resin as the binder resin. A polyester resin can be obtained through condensation polymerization of at least one polyhydric alcohol and at least one polycarboxylic acid. Examples of alcohols that can be used for synthesis of a polyester resin include dihydric alcohols (specific examples include diols and bisphenols) and tri- or higher-hydric alcohols listed below. Examples of carboxylic acids that can be used for synthesis of a polyester resin include dibasic carboxylic acids and tri- or higher-basic carboxylic acids listed below. Note that a polycarboxylic acid derivative that can form an ester bond through condensation polymerization, such as a polycarboxylic acid anhydride or a polycarboxylic acid halide may be used instead of the polycarboxylic acid.

Examples of preferable diols include ethylene glycol, diethylene glycol, triethylene glycol, 1,2-propanediol, 1,3-propanediol, 1,4-butanediol, neopentyl glycol, 2-butene-1,4-diol, 1,5-pentanediol, 2-pentene-1,5-diol, 1,6-hexanediol, 1,4-cyclohexanedimethanol, dipropylene glycol, 1,4-benzenediol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Colorant)

The toner mother particles may contain a colorant. A known pigment or dye that matches the color of the toner can be used as the colorant. In order to form high quality images with the toner, the amount of the colorant is preferably at least 1 part by mass and no greater than 20 parts by mass relative to 100 parts by mass of the binder resin.

The toner mother particles may contain a black colorant. An example of black colorants is carbon black. A colorant adjusted to black color using a yellow colorant, a magenta colorant, and a cyan colorant may also be used as a black colorant.

The toner mother particles may contain a non-black colorant. Examples of non-black colorants include a yellow colorant, a magenta colorant, and a cyan colorant.

At least one compound selected from the group consisting of condensed azo compounds, isoindolinone compounds, anthraquinone compounds, azo metal complexes, methine compounds, and arylamide compounds can for example be used as the yellow colorant. Examples of yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as the magenta colorant. Examples of magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

At least one compound selected from the group consisting of copper phthalocyanine compounds, anthraquinone compounds, and basic dye lake compounds can for example be used as the cyan colorant. Examples of cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner mother particles may contain a releasing agent. The releasing agent is used in order to improve offset resistance of the toner, for example. In order to improve offset resistance of the toner, the amount of the releasing agent is preferably at least 1 part by mass and no greater than 20 parts by mass relative to 100 parts by mass of the binder resin.

Examples of releasing agents that can be preferably used include: aliphatic hydrocarbon-based waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes such as polyethylene oxide wax and block copolymer of polyethylene oxide wax; plant waxes such as candelilla wax, carnauba wax, Japan wax, jojoba wax, and rice wax; animal waxes such as bees wax, lanolin, and spermaceti; mineral waxes such as ozokerite, ceresin, and petrolatum; ester waxes containing a fatty acid ester as a main component such as montanic acid ester wax and castor wax; and waxes in which a fatty acid ester is partially or wholly deoxidized (for example, a deoxidized carnauba wax). In the present embodiment, only one releasing agent may be used independently or two or more releasing agents may be used in combination.

A compatibilizer may be added to the toner mother particles in order to improve compatibility between the binder resin and the releasing agent.

(Charge Control Agent)

The toner mother particles may contain a charge control agent. The charge control agent is used in order to improve charge stability or a charge rise characteristic of the toner, for example. The charge rise characteristic of the toner is an indicator as to whether or not the toner is chargeable to a specific charge level in a short period of time. Cationic strength of the toner mother particles can be increased through a positively chargeable charge control agent contained in the toner mother particles.

Examples of positively chargeable charge control agents include: azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; metal salts of naphthenic acid; metal salts of higher organic carboxylic acid; alkoxylated amine; alkylamide; and quaternary ammonium salts such as benzyldecylhexylmethyl ammonium chloride, decyltrimethyl ammonium chloride, 2-(methacryloyloxy) ethyl trimethylammonium chloride, and dimethylaminopropyl acrylamide methyl chloride quaternary salt. Only one of the above-listed charge control agents may be used independently or two or more of the above-listed charge control agents may be used in combination.

In order to improve charge stability, the amount of the charge control agent is preferably at least 0.1 parts by mass and no greater than 10 parts by mass relative to 100 parts by mass of the binder resin.

(Magnetic Powder) The toner mother particles may contain a magnetic powder. Examples of materials of the magnetic powder include ferromagnetic metals (specific examples include iron, cobalt, and nickel), alloys of ferromagnetic metals, ferromagnetic metal oxides (specific examples include ferrite, magnetite, and chromium dioxide), and materials subjected to ferromagnetization (specific examples include carbon materials rendered ferromagnetic through thermal treatment). In the present embodiment, only one magnetic powder may be used independently or two or more magnetic powders may be used in combination.

(External Additive)

The toner particles included in the toner according to the present embodiment include the external additive attached to the surfaces of the toner mother particles. The external additive includes external additive particles (hereinafter may be referred to as specific external additive particles) each including a silica base and a coat layer covering the silica base. The coat layer of the specific external additive particle contains lanthanum atoms. The coat layer of the specific external additive particle has a surface subjected to hydrophobing treatment.

The silica base is not particularly limited. The silica base may be a silica particle that is not subjected to surface treatment or a silica particle subjected to surface treatment. However, in order to facilitate formation of the coat layer, the silica base is preferably a silica particle that is not subjected to surface treatment.

The coat layer contains lanthanum atoms. Examples of materials of the coat layer include lanthanum oxide and lanthanum hydroxide. In order to more favorably maintain positive chargeability in a high temperature and high humidity environment while more effectively inhibiting occurrence of fogging in continuous printing, a total amount of lanthanum oxide and lanthanum hydroxide contained in the coat layer is preferably at least 80% by mass, more preferably at least 90% by mass, and particularly preferably 100% by mass.

A method for forming the coat layer covering the silica base is not particularly limited so long as the coat layer containing lanthanum atoms can be formed. The following describes an example of methods for forming the coat layer covering the silica base.

Initially, the silica bases (for example, dry fumed silica particles) are suspended in pure water to obtain a slurry. Then, the slurry is heated to a temperature of at least 35° C. and no higher than 45° C. After the temperature adjustment, hydrochloric acid is added to the slurry to adjust pH of the slurry to a value of at least 2.5 and no greater than 3.5. Thereafter, lanthanum oxide is added to the resultant slurry under stirring, and the slurry is stirred while the temperature of the slurry is kept within a range of at least 35° C. and no higher than 45° C. The stirring is performed for example for at least 15 minutes and no longer than 60 minutes. The amount of lanthanum atoms contained in the specific external additive particles can be adjusted by changing the amount of lanthanum oxide added to the slurry. Solubility (or dispersibility) of lanthanum oxide in the slurry increases when pH of the slurry is adjusted to a value of at least 2.5 and no greater than 3.5. For this reason, lanthanum oxide is suitable as a material for forming the coat layer containing lanthanum atoms.

Subsequently, an aqueous sodium hydroxide solution is added to the slurry to adjust pH of the slurry to a value of at least 4.5 and no greater than 5.5. Thereafter, the slurry is stirred while the temperature of the slurry is kept within a range of at least 35° C. and no higher than 45° C. The stirring is performed for example for at least 30 minutes and no longer than 90 minutes. Through the above, lanthanum hydroxide precipitates on surfaces of the silica bases. Subsequently, an aqueous sodium hydroxide solution is added to the slurry to adjust pH of the slurry to a value of at least 6.5 and no greater than 7.5, thereby terminating precipitation of lanthanum hydroxide.

Subsequently, the resultant slurry is washed with water, filtered, and then dried. Through the above, a powder (hereinafter may be referred to as a coated silica powder) of particles each including the silica base and a coat layer covering the silica base (specifically, a coat layer containing lanthanum atoms) is obtained. Subsequently, the coated silica powder is baked at a temperature of at least 300° C. and no higher than 600° C. in an air atmosphere. The baking is performed for example for at least 30 minutes and no longer than 90 minutes. A mass ratio between lanthanum oxide and lanthanum hydroxide contained in the coat layer can be adjusted by changing at least one of the baking temperature and the baking time. Through the above method, the coat layer covering the silica base can be formed. Note that baking of the coated silica powder may be omitted.

At least one hydrophobing agent selected from the group consisting of silicone oils, silazane compounds, and silane compounds is preferably used for hydrophobing treatment on the surface of the coat layer. In order to more favorably maintain positive chargeability in a high temperature and high humidity environment, the hydrophobing agent is preferably a silane compound having a straight chain alkyl group having a carbon number of at least 4 and no greater than 12, and more preferably a triethoxysilane compound having a straight chain alkyl group having a carbon number of at least 4 and no greater than 8 (specific examples include n-butyltriethoxysilane and n-octyltriethoxysilane). When hydrophobing treatment is performed on the surface of the coat layer with a silane compound having a straight chain alkyl group having a carbon number of at least 4 and no greater than 12, the straight chain alkyl group having a carbon number of at least 4 and no greater than 12 is given to the surface of the coat layer. More specifically, when the surface of the coat layer is treated with a silane compound having a straight chain alkyl group having a carbon number of at least 4 and no greater than 12, a dehydration condensation reaction occurs between a hydroxyl group present on the surface of the coat layer and a hydroxyl group generated through hydrolysis of an alkoxy group of the silane compound by moisture. Through the above reaction, the silane compound having the straight chain alkyl group having a carbon number of at least 4 and no greater than 12 is chemically bonded to the lanthanum atom contained in the coat layer. Thus, the straight chain alkyl group (hydrophobic group) having a carbon number of at least 4 and no greater than 12 is given to the surface of the coat layer.

The surface of the coat layer of the specific external additive particle has the straight chain alkyl group having a carbon number of at least 4 and no greater than 12. Accordingly, the specific external additive particle has relatively high hydrophobicity. Therefore, positive chargeability can be more favorably maintained in a high temperature and high humidity environment.

In order to obtain a toner more excellent in positive chargeability, the surface of the coat layer is preferably subjected to positive-chargeability imparting treatment. A silane compound having an amino group (specific examples include 3-aminopropyltriethoxysilane) is preferably used as a positive-chargeability imparting agent for positive-chargeability imparting treatment on the surface of the coat layer. When positive-chargeability imparting treatment is performed on the surface of the coat layer with the silane compound having an amino group, the amino group is given to the surface of the coat layer. In a configuration in which the surface of the coat layer of the specific external additive particle has the amino group, the specific external additive particle tends to have strong positive chargeability.

In order to more favorably maintain positive chargeability in a high temperature and high humidity environment while more effectively inhibiting occurrence of fogging in continuous printing, the surfaces of the coat layers of the specific external additive particles preferably have a straight chain alkyl group having a carbon number of at least 4 and no greater than 12, more preferably have an amino group and a straight chain alkyl group having a carbon number of at least 4 and no greater than 12, and further preferably have an amino group and a straight chain alkyl group having a carbon number of at least 4 and no greater than 8. For the same reason, the surfaces of the coat layers of the specific external additive particles are particularly preferably treated with 3-aminopropyltriethoxysilane and at least one of n-butyltriethoxysilane and n-octyltriethoxysilane.

The external additive may include only the specific external additive particles, or may include additional external additive particles other than the specific external additive particles as well as the specific external additive particles. In order to favorably maintain fluidity of the toner, the additional external additive particles are preferably particles of a metal oxide (specific examples include particles of alumina, titania, magnesium oxide, zinc oxide, strontium titanate, and barium titanate). In the present embodiment, particles of a metal oxide may be used independently or particles of metal oxides may be used in combination.

In order to make the external additive sufficiently exhibit its function while inhibiting detachment of the external additive from the toner mother particles, the amount of the external additive (when additional external additive particles are used, a total amount of the specific external additive particles and the additional external additive particles) is preferably at least 1 part by mass and no greater than 10 parts by mass relative to 100 parts by mass of the toner mother particles.

<Toner Production Method>

The following describes a preferable method for producing the toner according to the above embodiment. Description of elements of configuration overlapping with description of the toner according to the above embodiment will be omitted.

[Toner Mother Particle Preparation Process]

First, toner mother particles are prepared by an aggregation method or a pulverization method.

The aggregation method includes for example an aggregation step and a coalescence step. In the aggregation step, fine particles containing components of the toner mother particles are caused to aggregate in an aqueous medium to form aggregated particles. In the coalescence step, the components contained in the aggregated particles are caused to coalesce in the aqueous medium to obtain the toner mother particles.

The following describes the pulverization method. The toner mother particles can be relatively easily prepared by the pulverization method. Furthermore, manufacturing cost can be reduced by the pulverization method. In a case where the toner mother particles are prepared by the pulverization method, preparation of the toner mother particles includes for example a melt kneading step and a pulverization step. The preparation of the toner mother particles may further include a mixing step before the melt kneading step. Also, the preparation of the toner mother particles may further include at least one of a fine pulverization step and a classification step after the pulverization step.

In the mixing step, a binder resin and one or more internal additives used as necessary are for example mixed to obtain a mixture. In the melt kneading step, a toner material is melt-kneaded to obtain a melt-kneaded product. The toner material is for example the mixture obtained through the mixing step. In the pulverization step, the obtained melt-kneaded product is cooled for example to room temperature (25° C.) and then pulverized to obtain a pulverized product. When the diameter of the pulverized product obtained through the pulverization step should be reduced, a step for further pulverizing the pulverized product (i.e., the fine pulverization step) may be performed. Also, in order to equalize the diameter of the pulverized product, a step for classifying the pulverized product (i.e., the classification step) may be performed. Through the above steps, the toner mother particles as the pulverized product are obtained.

[External Additive Addition Process]

Thereafter, the obtained toner mother particles and an external additive including at least the specific external additive particles are mixed using a mixer (for example, "MULTI-PURPOSE MIXER" manufactured by Nippon Coke & Engineering Co., Ltd.) to attach the external additive to surfaces of the toner mother particles. Through the above, a toner including toner particles is obtained.

EXAMPLES

The following describes examples of the present disclosure together with comparative examples.

<Preparation of External Additives>

[Preparation of External Additive EA-1]

First, 50 g of dry fumed silica particles ("REOLOSIL (registered Japanese trademark) QS-10" manufactured by Tokuyama Corporation) as silica bases were suspended in 300 g of pure water to obtain a slurry. The slurry was heated to a temperature of 40° C. Then, hydrochloric acid (hydrogen chloride concentration: 1 mol/L) was added to the slurry at the temperature of 40° C. to adjust pH of the slurry to 3.

Subsequently, while the slurry at the temperature of 40° C. obtained as above was stirred, lanthanum oxide (product of Wako Pure Chemical Industries, Ltd.) in an amount of 15% by mass relative to the mass of the silica bases was added to the slurry. Subsequently, the slurry was stirred for 30 minutes while the temperature of the slurry was kept at 40° C. Subsequently, a 1 mol/L aqueous sodium hydroxide solution was added to the slurry to adjust pH of the slurry to 5, and thereafter the slurry was stirred for 1 hour while the temperature of the slurry was kept at 40° C. Through the above, lanthanum hydroxide was precipitated on surfaces of the silica bases. Subsequently, 1 mol/L aqueous sodium hydroxide solution was added to the slurry to adjust pH of the slurry to 7, thereby terminating precipitation of lanthanum hydroxide.

Subsequently, the obtained slurry was washed with water, filtered, and then dried using a dryer (drying temperature: 130° C., drying time: 12 hours) to obtain a powder. The powder was a powder (coated silica powder) of particles each including the silica base and a coat layer (specifically, a coat layer containing lanthanum atoms) covering the silica base. Surfaces of the silica bases included in the obtained coated silica powder were each completely covered with the coat layer. Subsequently, the obtained coated silica powder was baked for 1 hour at a temperature of 300° C. in an air atmosphere.

Subsequently, while 50 g of the baked coated silica powder was stirred using a compact porcelain bowl mortar machine ("ISHIKAWA STIRRING MORTAR MACHINE No. 22" manufactured by ISHIKAWA KOJO Co., Ltd.), 3-aminopropyltriethoxysilane in an amount of 15% by mass relative to the mass of the coated silica powder was added to the coated silica powder. Thereafter, the coated silica powder was stirred for 30 minutes using the mortar machine (ISHIKAWA STIRRING MORTAR MACHINE No. 22). Subsequently, n-butyltriethoxysilane in an amount of 10% by mass relative to the mass of the coated silica powder (mass before addition of 3-aminopropyltriethoxysilane) was added to the coated silica powder while the coated silica powder was stirred using the mortar machine (ISHIKAWA STIRRING MORTAR MACHINE No. 22). Thereafter, the coated silica powder was stirred for 30 minutes using the mortar machine (ISHIKAWA STIRRING MORTAR MACHINE No. 22). Subsequently, thermal treatment was performed on the coated silica powder treated with 3-aminopropyltriethoxysilane and n-butyltriethoxysilane at a temperature of 90° C. for 48 hours using a dryer. Thereafter, the coated silica powder subjected to thermal treatment was deagglomerated, whereby an external additive EA-1 was obtained. The external additive EA-1 included external additive particles each including the silica base and the coat layer covering the silica base (specifically, the coat layer containing lanthanum atoms), and surfaces of the coat layers had been subjected to positive-chargeability imparting treatment and hydrophobing treatment. The external additive particles included in the external additive EA-1 had a number average primary particle diameter of 20 nm.

[Preparation of External Additive EA-2]

An external additive EA-2 was obtained by the same method as that for preparation of the external additive EA-1 in all aspects other than that the amount of lanthanum oxide (product of Wako Pure Chemical Industries, Ltd.) was changed to 25% by mass relative to the mass of the silica bases. The external additive EA-2 included external additive particles each including the silica base and the coat layer covering the silica base (specifically, the coat layer containing lanthanum atoms), and surfaces of the coat layers had been subjected to positive-chargeability imparting treatment and hydrophobing treatment. The external additive particles included in the external additive EA-2 had a number average primary particle diameter of 21 nm.

[Preparation of External Additive EA-3]

An external additive EA-3 was obtained by the same method as that for preparation of the external additive EA-1 in all aspects other than that the amount of lanthanum oxide (product of Wako Pure Chemical Industries, Ltd.) was changed to 35% by mass relative to the mass of the silica bases. The external additive EA-3 included external additive particles each including the silica base and the coat layer covering the silica base (specifically, the coat layer containing lanthanum atoms), and surfaces of the coat layers had been subjected to positive-chargeability imparting treatment and hydrophobing treatment. The external additive particles included in the external additive EA-3 had a number average primary particle diameter of 22 nm. [Preparation of External Additive EA-4]

An external additive EA-4 was obtained by the same method as that for preparation of the external additive EA-1 in all aspects other than that the amount of lanthanum oxide (product of Wako Pure Chemical Industries, Ltd.) was changed to 25% by mass relative to the mass of the silica bases, and n-octyltriethoxysilane (in an amount of 10% by mass relative to the mass of the coated silica powder) was used instead of n-butyltriethoxysilane (in an amount of 10% by mass relative to the mass of the coated silica powder). The external additive EA-4 included external additive particles each including the silica base and the coat layer covering the silica base (specifically, the coat layer containing lanthanum atoms), and surfaces of the coat layers had been subjected to positive-chargeability imparting treatment and hydrophobing treatment. The external additive particles included in the external additive EA-4 had a number average primary particle diameter of 19 nm.

[Preparation of External Additive EA-5]

An external additive EA-5 was obtained by the same method as that for preparation of the external additive EA-1 in all aspects other than that the amount of lanthanum oxide (product of Wako Pure Chemical Industries, Ltd.) was changed to 25% by mass relative to the mass of the silica bases, and baking was not performed. The external additive EA-5 included external additive particles each including the silica base and the coat layer covering the silica base (specifically, the coat layer containing lanthanum atoms), and surfaces of the coat layers had been subjected to positive-chargeability imparting treatment and hydrophobing treatment. The external additive particles included in the external additive EA-5 had a number average primary particle diameter of 21 nm.

[Preparation of External Additive EA-6]

An external additive EA-6 was obtained by the same method as that for preparation of the external additive EA-1 in all aspects other than that the amount of lanthanum oxide (product of Wako Pure Chemical Industries, Ltd.) was changed to 25% by mass relative to the mass of the silica bases, and the temperature for baking (baking temperature)

was changed to 600° C. The external additive EA-6 included external additive particles each including the silica base and the coat layer covering the silica base (specifically, the coat layer containing lanthanum atoms), and surfaces of the coat layers had been subjected to positive-chargeability imparting treatment and hydrophobing treatment. The external additive particles included in the external additive EA-6 had a number average primary particle diameter of 20 nm.

[Preparation of External Additive EA-7]

An external additive EA-7 was obtained by the same method as that for preparation of the external additive EA-1 in all aspects other than changes described below. The external additive EA-7 included external additive particles each including the silica base and the coat layer covering the silica base (specifically, the coat layer containing lanthanum atoms), and surfaces of the coat layers had been subjected to hydrophobing treatment. The external additive particles included in the external additive EA-7 had a number average primary particle diameter of 23 nm.

(Changes)

In preparation of the external additive EA-7, the amount of lanthanum oxide (product of Wako Pure Chemical Industries, Ltd.) was changed to 25% by mass relative to the mass of the silica bases. In preparation of the external additive EA-7, the temperature for baking (baking temperature) was changed to 600° C. In preparation of the external additive EA-7, surface treatment with 3-aminopropyltriethoxysilane was not performed.

[Preparation of External Additive EB-1]

An external additive EB-1 was obtained by the same method as that for preparation of the external additive EA-1 in all aspects other than that 50 g of dry fumed silica particles ("REOLOSIL (registered Japanese trademark) QS-10" manufactured by Tokuyama Corporation) was used instead of 50 g of the baked coated silica powder as a target (powder) of surface treatment performed using the mortar machine (ISHIKAWA STIRRING MORTAR MACHINE No. 22). The external additive EB-1 included external additive particles that did not include coat layers containing lanthanum atoms. The external additive particles included in the external additive EB-1 had a number average primary particle diameter of 18 nm.

[Preparation of External Additive EB-2]

An external additive EB-2 was obtained by the same method as that for preparation of the external additive EA-1 in all aspects other than that the amount of lanthanum oxide (product of Wako Pure Chemical Industries, Ltd.) was changed to 25% by mass relative to the mass of the silica bases, and surface treatment (positive-chargeability imparting treatment and hydrophobing treatment) using the mortar machine (ISHIKAWA STIRRING MORTAR MACHINE No. 22) was not performed. The external additive EB-2 included external additive particles each including a coat layer containing lanthanum atoms, and surfaces of the coat layers had been subjected to neither positive-chargeability imparting treatment nor hydrophobing treatment. The external additive particles included in the external additive EB-2 had a number average primary particle diameter of 22 nm.

[Preparation of External Additive EB-3]

An external additive EB-3 was obtained by the same method as that for preparation of the external additive EA-1 in all aspects other than that 50 g of lanthanum oxide (product of Wako Pure Chemical Industries, Ltd.) was used instead of 50 g of the baked coated silica powder as a target (powder) of surface treatment performed using the mortar machine (ISHIKAWA STIRRING MORTAR MACHINE No. 22). The external additive EB-3 included external additive particles that did not include silica bases. The external additive particles included in the external additive EB-3 had a number average primary particle diameter of 300 nm.

<Measurement of Amount of Lanthanum Atoms (in Terms of $La_2O_3$)>

First, 0.5 g of an external additive (any of the external additives EA-1 to EA-7 and EB-2) as a measurement target was subjected to pressure molding using a briquetting press ("BRE-33" manufactured by MAEKAWA TESTING MACHINE MFG. Co., Ltd.) to obtain a cylindrical pellet having a diameter of 20 mm. Fluorescent X-ray analysis was performed on the obtained pellet under the following conditions to obtain a fluorescent X-ray spectrum (horizontal axis: energy, vertical axis: intensity (number of photons)) including a peak derived from lanthanum (La).

[Conditions for Fluorescent X-Ray Analysis]

Analyzer: X-ray fluorescence spectrometer ("ZSX 100e" manufactured by Rigaku Corporation)

X-ray tube (X-ray source): Rh (rhodium)

Excitation conditions: tube voltage of 50 kV, tube current of 60 mA

Analyzing crystal: LiF

Detector: scintillation detector

Measurement range (X-ray irradiation range): diameter of 20 mm

Measurement atmosphere: vacuum (20 Pa)

An X-ray intensity of the peak derived from lanthanum (La) in the obtained fluorescent X-ray spectrum was converted into an amount of lanthanum oxide (unit: % by mass) using a calibration curve prepared beforehand by the following method. A value obtained through the conversion was determined to be the amount of lanthanum atoms contained in the external additive as the measurement target (specifically, the amount of lanthanum atoms relative to a mass of the external additive particles included in the external additive as the measurement target) in terms of $La_2O_3$ (hereinafter may be referred to as a lanthanum atom content in terms of $La_2O_3$).

[Calibration Curve Preparation Method]

A plurality of powder samples each being a mixture of dry fumed silica particles ("REOLOSIL (registered Japanese trademark) QS-10") and lanthanum oxide (product of Wako Pure Chemical Industries, Ltd.) was prepared. Specifically, the prepared powder samples respectively included the following amounts of lanthanum oxide relative to a total mass of the dry fumed silica particles and lanthanum oxide: 1% by mass; 5% by mass; 10% by mass; 15% by mass; 20% by mass; and 25% by mass. Next, 0.5 g of each powder sample was subjected to pressure molding using a briquetting press ("BRE-33" manufactured by MAEKAWA TESTING MACHINE MFG. Co., Ltd.) to obtain a cylindrical pellet having a diameter of 20 mm. With respect to each pellet obtained as above, fluorescent X-ray analysis was performed under the same conditions as those described above. The calibration curve was prepared by plotting X-ray intensities of peaks derived from lanthanum (La) included in respective fluorescent X-ray spectra obtained as above and amounts of lanthanum oxide (unit: % by mass) contained in the corresponding pellets.

Table 1 shows, with respect to each of the external additives EA-1 to EA-7 and EB-1 to EB-3, whether or not positive-chargeability imparting treatment was performed, whether or not hydrophobing treatment was performed, and a lanthanum atom content in terms of $La_2O_3$. Note that "-" shown in the column titled "Lanthanum atom content in terms of $La_2O_3$" in Table 1 indicates that the lanthanum atom content in terms of $La_2O_3$ could not be measured.

TABLE 1

| External additive | Positive-chargeability imparting treatment | Hydrophobing treatment | Lanthanum atom content in terms of $La_2O_3$ [% by mass] |
|---|---|---|---|
| EA-1 | Performed | Performed | 10.8 |
| EA-2 | Performed | Performed | 16.5 |
| EA-3 | Performed | Performed | 21.3 |
| EA-4 | Performed | Performed | 16.3 |
| EA-5 | Performed | Performed | 16.4 |
| EA-6 | Performed | Performed | 16.4 |
| EA-7 | Not performed | Performed | 12.0 |
| EB-1 | Performed | Performed | — |
| EB-2 | Not performed | Not performed | 17.8 |
| EB-3 | Performed | Performed | — |

<Production of Toners>

[Production of Toner TA-1]

An external additive-free cyan toner (volume median diameter ($D_{50}$): 6.8 μm) for "TASKalfa5550ci" manufactured by KYOCERA Document Solutions Inc. was prepared as toner mother particles. Then, 100 parts by mass of the toner mother particles and 2 parts by mass of the external additive EA-1 were mixed using a multi-purpose compact mixing pulverizing machine ("MULTI-PURPOSE MIXER" manufactured by Nippon Coke & Engineering Co., Ltd.) at a rotational speed of 4,000 rpm for 3 minutes. Through the above, the external additive EA-1 was attached to surfaces of the toner mother particles. Subsequently, the resultant powder was sifted using a 200-mesh sieve (pore size: 75 μm). As a result, a positively chargeable toner TA-1 was obtained.

[Production of Toners TA-2 to TA-7 and TB-1 to TB-3]

Each of toners TA-2 to TA-7 and TB-1 to TB-3 was produced by the same method as that for production of the toner TA-1 in all aspects other than that a corresponding external additive shown in Table 2 was used instead of the external additive EA-1. The toners TA-2 to TA-7 and TB-1 to TB-3 were each a positively chargeable toner.

<Evaluation Methods>

Each of samples (the toners TA-1 to TA-7 and TB-1 to TB-3) was evaluated by the following methods.

[Preparation of Evaluation Developer]

An evaluation developer (two-component developer) was prepared by mixing 100 parts by mass of a developer carrier (carrier for "TASKalfa5550ci" manufactured by KYOCERA Document Solutions Inc.) and 10 parts by mass of a toner to be evaluated using a ball mill for 30 minutes.

[Anti-Fogging Performance]

A multifunction peripheral ("TASKalfa5550ci" manufactured by KYOCERA Document Solutions Inc.) was used as an evaluation apparatus. The evaluation developer prepared as above was loaded into a development device for cyan color in the evaluation apparatus and a toner for replenishment use (toner to be evaluated) was loaded into a toner container for cyan color in the evaluation apparatus. Then, an image of a coverage of 2% was successively printed on 5,000 sheets of printing paper (A4 size) using the evaluation apparatus in an environment at a temperature of 20° C. and a relative humidity of 65%. Next, an image of a coverage of 50% (pattern image including a solid portion and a blank portion) was successively printed on 1,000 sheets of printing paper (A4 size) using the evaluation apparatus. A reflection density of the blank portion of each sheet with the image of a coverage of 50% printed thereon was measured using a reflectance densitometer ("SPECTROEYE (registered Japanese trademark)" manufactured by X-Rite Inc.). Then, a fogging density (FD) was calculated by the following equation.

$$\text{Fogging density} = \text{reflection density of blank portion} - \text{reflection density of unprinted paper}$$

A largest fogging density (highest fogging density) among all measured fogging densities (FD) was then determined. Results are shown in Table 2. When the highest fogging density was smaller than 0.006, it was judged that "occurrence of fogging in continuous printing was particularly effectively inhibited". When the highest fogging density was at least 0.006 and smaller than 0.010, it was judged that "occurrence of fogging in continuous printing was inhibited". When the highest fogging density was at least 0.010, it was judged that "occurrence of fogging in continuous printing was not be inhibited".

[Measurement of Amount of Charge in High Temperature and High Humidity Environment]

After the evaluation developer was prepared by the above-described method, the evaluation developer was left to stand in a high temperature and high humidity environment at a temperature of 32.5° C. and a relative humidity of 80% for 24 hours. Thereafter, an amount of charge (unit: μC/g) of the toner included in the evaluation developer was measured using a Q/m meter in a high temperature and high humidity environment at a temperature of 32.5° C. and a relative humidity of 80%. The amount of charge was measured using the Q/m meter by a method details of which are described below.

(Method for Measuring Amount of Charge Using Q/m Meter)

First, 0.10 g of the evaluation developer was placed in a measurement cell of the Q/m meter ("MODEL 210HS-1" manufactured by TREK, INC.), and only the toner was sucked from the evaluation developer via a sieve (wire netting) for 10 seconds. An amount of charge (unit: μC/g) of the toner was calculated by the following expression "total amount of electricity (unit: μC) of the sucked toner/mass (unit: g) of the sucked toner".

Table 2 shows amounts of charge in the high temperature and high humidity environment measured by the above-described method. When the amount of charge in the high temperature and high humidity environment was at least 15 μC/g, it was judged that "positive chargeability was particularly favorably maintained in the high temperature and high humidity environment". When the amount of charge in the high temperature and high humidity environment was at least 10 μC/g and smaller than 15 μC/g, it was judged that "positive chargeability was favorably maintained in the high temperature and high humidity environment". When the amount of charge in the high temperature and high humidity environment was smaller than 10 μC/g, it was judged that "positive chargeability was not favorably maintained in the high temperature and high humidity environment".

TABLE 2

| | Toner | External additive | Highest fogging density | Amount of charge in high temperature and high humidity environment [μC/g] |
|---|---|---|---|---|
| Example 1 | TA-1 | EA-1 | 0.008 | 19.5 |
| Example 2 | TA-2 | EA-2 | 0.004 | 15.1 |
| Example 3 | TA-3 | EA-3 | 0.003 | 12.6 |
| Example 4 | TA-4 | EA-4 | 0.004 | 22.8 |

TABLE 2-continued

| | Toner | External additive | Highest fogging density | Amount of charge in high temperature and high humidity environment [μC/g] |
|---|---|---|---|---|
| Example 5 | TA-5 | EA-5 | 0.002 | 20.2 |
| Example 6 | TA-6 | EA-6 | 0.003 | 19.5 |
| Example 7 | TA-7 | EA-7 | 0.002 | 10.2 |
| Comparative Example 1 | TB-1 | EB-1 | 0.018 | 18.5 |
| Comparative Example 2 | TB-2 | EB-2 | 0.002 | 5.7 |
| Comparative Example 3 | TB-3 | EB-3 | 0.002 | 7.3 |

The toners TA-1 to TA-7 each included external additive particles each including a silica base and a coat layer covering the silica base (specifically, a coat layer containing lanthanum atoms), and surfaces of the coat layers had been subjected to hydrophobing treatment.

As shown in Table 2, the highest fogging density of the toner TA-1 was at least 0.006 and smaller than 0.010. This indicates that occurrence of fogging in continuous printing was inhibited through use of the toner TA-1. The highest fogging density of each of the toners TA-2 to TA-7 was smaller than 0.006. This indicates that occurrence of fogging in continuous printing was particularly effectively inhibited through use of any of the toners TA-2 to TA-7. Each of the toners TA-1, TA-2, and TA-4 to TA-6 had an amount of charge of at least 15 μC/g in the high temperature and high humidity environment. This indicates that positive chargeability of the toners TA-1, TA-2, and TA-4 to TA-6 was particularly favorably maintained in the high temperature and high humidity environment. The toners TA-3 and TA-7 each had an amount of charge of at least 10 μC/g and smaller than 15 μC/g in the high temperature and high humidity environment. This indicates that positive chargeability of the toners TA-3 and TA-7 was favorably maintained in the high temperature and high humidity environment.

The toner TB-1 included external additive particles that did not include coat layers containing lanthanum atoms. The toner TB-2 included external additive particles including coat layers containing lanthanum atoms, but surfaces of the coat layers had not been subjected to hydrophobing treatment. The toner TB-3 included external additive particles that did not include silica bases.

As shown in Table 2, the highest fogging density of the toner TB-1 was at least 0.010. This indicates that occurrence of fogging in continuous printing was not inhibited through use of the toner TB-1. The toners TA-2 and TA-3 each had an amount of charge of smaller than 10 μC/g in the high temperature and high humidity environment. This indicates that positive chargeability of the toners TB-2 and TB-3 was not favorably maintained in the high temperature and high humidity environment. The above results show that according to the toner of the present disclosure, positive chargeability can be favorably maintained in a high temperature and high humidity environment while occurrence of fogging in continuous printing can be inhibited.

What is claimed is:

1. A positively chargeable toner comprising toner particles, wherein the toner particles each include a toner mother particle and an external additive attached to a surface of the toner mother particle, the external additive includes external additive particles each including a silica base and a coat layer covering the silica base, the coat layer contains lanthanum atoms, and the coat layer has a surface having hydrophobicity.

2. The positively chargeable toner according to claim 1, wherein an amount of the lanthanum atoms in terms of $La_2O_3$ is at least 10% by mass and no greater than 30% by mass relative to a mass of the external additive particles.

3. The positively chargeable toner according to claim 1, wherein the coat layer has a straight chain alkyl group having a carbon number of at least 4 and no greater than 12 at the surface thereof.

4. The positively chargeable toner according to claim 3, wherein the coat layer further has an amino group at the surface thereof.

5. The positively chargeable toner according to claim 4, wherein the surface of the coat layer is a surface treated with 3-aminopropyltriethoxysilane and at least one of n-butyltriethoxysilane and n-octyltriethoxysilane.

6. The positively chargeable toner according to claim 1, wherein the external additive particles have a number average primary particle diameter of at least 15 nm and no greater than 30 nm.

* * * * *